United States Patent [19]

Yamaguchi et al.

[11] Patent Number: 4,562,322

[45] Date of Patent: Dec. 31, 1985

[54] $SF_6$ GAS ARC EXTINGUISHING ELECTRIC APPARATUS AND PROCESS FOR PRODUCING THE SAME

[75] Inventors: Motoo Yamaguchi; Isamu Sone; Kunio Hirasawa; Yoshio Yoshioka; Akio Nishikawa; Hiroshi Suzuki; Mikio Sato; Masao Hosokawa, all of Hitachi, Japan

[73] Assignee: Hitachi, Ltd., Tokyo, Japan

[21] Appl. No.: 682,947

[22] Filed: Dec. 18, 1984

Related U.S. Application Data

[63] Continuation of Ser. No. 383,183, May 28, 1982, abandoned.

[30] Foreign Application Priority Data

Jun. 3, 1981 [JP] Japan ..... 56-86240

[51] Int. Cl.[4] ..... H01H 33/82

[52] U.S. Cl. ..... 200/148 G; 200/148 B; 174/110 N

[58] Field of Search ..... 200/148 G, 148 B, 148 R; 174/110 N

[56] References Cited

U.S. PATENT DOCUMENTS 3,179,634 4/1965 Edwards ..... 174/110 N
3,406,269 10/1968 Fischer ..... 200/148 G

FOREIGN PATENT DOCUMENTS 998866 7/1965 United Kingdom ..... 200/148 G

*Primary Examiner*—Robert S. Macon
*Attorney, Agent, or Firm*—Antonelli, Terry & Wands

[57] ABSTRACT

A $SF_6$ gas insulating electric apparatus usable as a circuit breaker, etc., containing a $SF_6$ gas insulator and a resin insulator, both of which insulators are present in an atmosphere to be exposed to arcs, characterized by making at least the surface portion to be exposed to arcs of the resin insulator from a polymer containing nitrogen atoms or a polyolefin resin, and if necessary together with an inorganic filler powder, is excellent in both surface and inner arc resistance and can maintain breaking performance for a long period of time.

19 Claims, 2 Drawing Figures

$SF_6$ GAS ARC EXTINGUISHING ELECTRIC APPARATUS AND PROCESS FOR PRODUCING THE SAME

This is a continuation of application Ser. No. 383,183, filed May 28, 1982, abandoned.

This invention relates to a $SF_6$ gas arc extinguishing electric apparatus such as a $SF_6$ gas blast breaker and the like, and a process for producing the same.

In circuit breakers, arcs generated at the time of circuit breaking are extinguished by using a gas having high dielectric strength such as sulfur hexafluoride, $SF_6$, etc. In such a case, an arc-extinguishing nozzle made from a resin insulator is decomposed by energy from the arc, which results in lowering properties such as breaking performance and voltage resistance. In order to remove such disadvantages as mentioned above, there is proposed in Japanese Patent Appln. Kokoku (Post-Exam Publn) No. 28639/78 a circuit breaker using a resin insulator a fluorocarbon resin mixed with a large amount of 10 to 80% by volume of an inorganic filler such as a metal, e.g., bronze, a metal oxide, e.g., silicon oxide, titanium oxide, aluminum oxide, etc., having a particle size of 3 to 20 μm. Since a large amount of the inorganic filler is mixed in the resin insulator used in the breaker, the arc energy is extinguished to give good inner arc resistance. But according to experiments conducted by the present inventors, when an electric current of 300 kV and 50 kA was broken one time by using such a circuit breaker, the fluorocarbon resin insulator produced free carbon and did not show sufficient breaking performance. Further, the surface portion of the resin insulator exposed to an arc generated at the time of breaking lowered greatly its insulating properties and the insulating performance thereafter was lowered remarkably due to melting, flying and losing of the resin. In addition, there was another problem in mechanical strength due to poor adhesiveness between the inorganic filler and the fluorocarbon resin.

This invention provides a $SF_6$ gas arc extinguishing electric apparatus suitable for use as circuit breakers and containing a resin insulator excellent in surface arc resistance and inner arc resistance overcoming the disadvantages mentioned above, and a process for producing the same.

In accordance with this invention, there is provided a $SF_6$ gas arc extinguishing electric apparatus containing a $SF_6$ arc extinguishing gas and a resin insulator, both of which are present in an atmosphere to be exposed to arcs, characterized in that at least the surface portion to be exposed to arcs of said resin insulator is made from a polymer containing nitrogen atoms (hereinafter referred to as "nitrogen-containing polymer") and a polyolefin resin, or made from a nitrogen-containing polymer, a polyolefin resin and an inorganic filler powder.

Figure 1:
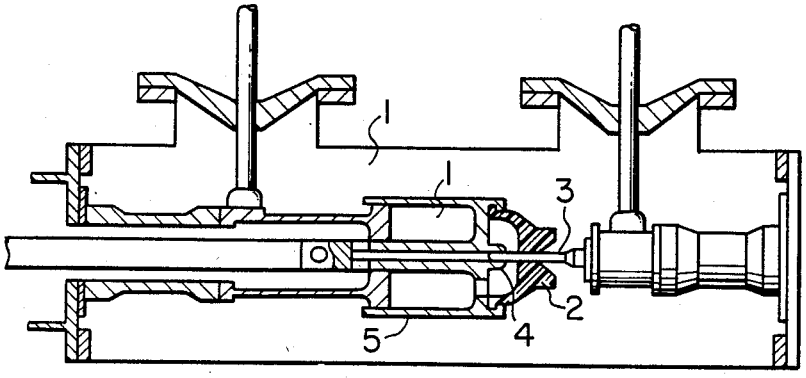
Figure 2:
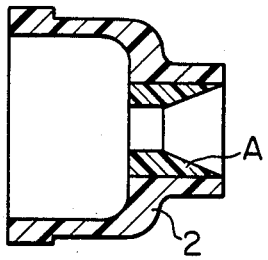

In the attached drawings,

FIG. 1 is a cross-sectional view of a $SF_6$ gas arc extinguishing breaker which is one example of this invention and FIG. 2 is an enlarged cross-sectional view of one example of an arc-extinguishing nozzle used in the breaker of FIG. 1.

The present inventors have found that nitrogen-containing polymers such as polyimides, polyamides, etc., remarkably improve surface arc resistance and inner arc resistance of polyolefin resins such as polyethylene, a fluorocarbon resin and further improve adhesiveness with the polyolefin resin and the inorganic filler powder, and accomplished this invention.

As the nitrogen-containing polymers, there can be used, for example, addition type and condensation type polyimides, a polyamideimide, a polyetherimide, a polyesterimide, a polyimideisoindroquinazolinedione, a polyimidebenzimidazole, a polybenzimidazole, a polybenzoimidazoquinazolone, a polybenzoxazole, a polyimideoxazole, a polybenzthiazole, a polyquinazolinequinazolone, a polyquinoxaline, a polypyrrolone, a polyquinone, a polytriazine, a polytriazole, a polypyrazole, a polyquinazolinedione, a polybenzooxazinone, a polyquinazolone, a polyisoindroquinazolinedione, a polyindolone, a polyindoloquinoxaline, a polybenzimidazoquinazoline, aliphatic polyamides, aromatic polyamides such as polyetheramide, polyesteramide, etc., a polyphenylhydrazide, a polyazomethine, a polyaldazine, a poly(Schiff base), a polythioquinazolinedione, a polytetraazopyrene, a polynaphthylidine, a polyoxadiazole, a polythiadiazole, a polyisocyanurate, a polyoxazolidone, a polyisocyanurateoxazolidone, a polyhydantoin, a poly(parabanic acid), etc. These nitrogen-containing polymers can be used alone or as a mixture thereof.

Among them, particularly preferable ones are those having excellent heat resistance such as polyimides and aromatic polyamides. Most preferable nitrogen-containing polymers are those having the same or higher heat resistance compared with the polyolefin resin to be used together. For example, a fluorocarbon resin is used as the polyolefin resin, the nitrogen-containing polymer is one having a softening point, a melting point or a decomposition point of about 300° C. or higher. When a polyimide resin is used, the addition to the polyolefin resin may be any time before or after the formation of imide rings. More preferably, a poly(amic acid) which is a precursor of a polyimide resin is added to a polyolefin resin, and then the whole is subjected to a heat treatment to form imide rings.

In the case of using an inorganic filler powder which will be explained below, it is preferable that a poly(amic acid) is mixed with a polyolefin resin and an inorganic filler powder, followed by heat treatment of the whole to form imide rings. A further effective method in the case of co-use of an inorganic filler powder is to coat the surfaces of the powder particles with a poly(amic acid), to subject to heat treatment and to add a polyolefin resin thereto, or to add an inorganic filler powder coated with a poly(amic acid) to a polyolefin resin, followed by heat treatment. In this invention, the formation of imide rings after the addition to the polyolefin resin is preferable from the viewpoint of mechanical strength. When a polyimide resin is added to a polyolefin resin in the state of a precursor, poly(amic acid), a powder of said precursor may directly be added to the polyolefin resin or a varnish obtained by dissolving the precursor in a solvent may be added to the polyolefin resin. Examples of such a solvent are phenols, cresols, toluene, xylene, dimethylsulfoxide, N-methyl-2-pyrrolidone, N,N-dimethylacetamide, dimethylformamide, etc. Further, in the case of coating the inorganic filler powder with a poly(amic acid), a varnish of poly(amic acid) is first prepared as mentioned above, and then is coated on the surfaces of the powder.

As the polyolefin resin, there can be used a polyethylene, a polypropylene, an ethylene-propylene copolymer, a halogenated polyolefin such as a fluorocarbon resin. Examples of fluorocarbon resins usable in this invention include polytetrafluoroethylene (PTFE), a fluorine-terminated ethylene-propylene copolymer (FEP), polyperfluoroalkoxy (PFA), an ethylene-tetrafluoroethylene copolymer (ETFE), a polychlorotrifluoroethylene (PCTFE), poly(vinylidene fluoride) (PVDF), a poly(vinyl fluoride) (PVF), a polytetrafluoroethylene (TFE), a chlorotrifluoroethyleneethylene copolymer, a tetrafluoroethylene-perfluorovinyl ether copolymer, etc. These polyolefin resins can be used alone or as a mixture thereof.

As the inorganic filler powder, there can be used any conventional fillers for filling resinous insulating materials. Among them, those having high thermal conductivity, light screening properties, or light reflectance are effective. Examples of the fillers are glass fibers, graphite, bronze, molybdenum disulfide, silicon carbide, boron nitride, calcium fluoride, alumina, clay, barium sulfate, carbon fibers, polyimide fibers, polybenzimidazole fibers, polyamide fibers, diatomaceous earth, acid clay, silica, mica, talc, beryllia, asbestos, boron fibers, various metal fibers, etc. These fillers can be used alone or as a mixture thereof. These fillers are used in the form of powder preferably having a particle size of less than 300 $\mu$m. From the viewpoint of light screening properties, there can effectively be used inorganic pigments such as carbon, ferric oxide ($Fe_2O_3$), titanium oxide ($TiO_2$), ultramarine, white lead, zinc oxide, chrome yellows, zinc chromate, cadmium yellows, cadmium orange, cadmium reds, cobalt green, iron oxide yellows, etc.

In this invention, irrespective of the above-mentioned inorganic fillers, there can be used one or more organic pigments such as ada-lake, naphthol green, naphthol yellow, permanent red, benzidine yellow, lithol red, lake red, scarlet, fast sky blue, Hansa yellow, permanent orange, permanent yellow, permanent bordeaux phthalocyanine green, phthalocyanine blue, rhodamine lake, bordeaux, watching red, benzidine orange, methyl violet, peacock blue lake, indanthrene blue, alizarin blue, quinacridone red, aniline black, etc., alone or as a mixture thereof.

The nitrogen-containing polymer can be used in an amount of preferably 0.01 to 10 parts by weight, more preferably 0.1 to 10 parts by weight, the polyolefin resin can be used in an amount of preferably 0.1 to 10 parts by weight. When the inorganic filler powder is used, it can be used preferably in an amount of 0.1 to 20 parts by weight, more preferably 0.1 to 10 parts by weight. The organic pigment can be used preferably in an amount of 0.1 to 10 parts by weight.

In order to enhance adhesive strength between the inorganic filler powder and the polyolefin resin or the nitrogen-containing polymer, there can be used one or more coupling agents. Examples of the coupling agents are silane series coupling agents such as epoxysilane, aminosilane, vinylsilane, and the like, titanate series coupling agents such as alkoxy titanates, and the like, aluminum chelate series coupling agents, aluminum alkoxy series coupling agents, and fluorosilicone coupling agents. When the inorganic filler powder is pretreated with a coupling agent, the effect of coupling agent can be attained by only a small amount thereof. The coupling agent can also be added to the resin or resins. In such a case, the heat treatment of the resin can be conducted either before or after the addition.

One example of the $SF_6$ gas arc extinguishing electric apparatus of this invention is shown in FIG. 1. FIG. 1 is a cross-sectional view of a $SF_6$ insulating gas insulating breaker, in which numeral 1 denotes a $SF_6$ arc extinguishing gas, numeral 2 denotes an arc-extinguishing nozzle for leading the $SF_6$ arc extinguishing to arcs (said nozzle is conventionally made from a fluorocarbon resin), numeral 3 denotes a fixed contact, numeral 4 denotes a moving contact and numeral 5 denotes a gas compressing apparatus for blowing the $SF_6$ gas 1 to arcs. In this invention, the words "the portion to be exposed to arcs" mean an arc-extinguishing nozzle, particularly its orifice portion, in a $SF_6$ gas arc extinguishing breaker as shown in FIG. 1, which portion is very near to arcs or in contact with arcs and, therefore, is particularly required to have good arc resistance. Further, the words "the surface portion" mean as follows. That is, all of the portion to be exposed to arcs is not always made from a resin insulator comprising the above-mentioned nitrogen-containing polymer and polyolefin resin or if necessary together with the inorganic filler powder. This means that the arc-extinguishing nozzle 2 in the breaker of FIG. 1 is not always required to be produced from a special resin insulator comprising a nitrogen-containing polymer and a polyolefin resin, and if necessary an inorganic filler powder together therewith. Only the surface portion A which is exposed to arcs as shown in FIG. 2 should be made from such a special resin insulator. For example, the body of the arc-extinguishing nozzle is made from an epoxy resin or a fluorocarbon resin and the surface portion thereof is coated with a coating layer of such a special resin insulator.

The formation of the coating layer can be carried out by the following methods:

(1) A method of coating a mixed solution obtained by dispersing or dissolving a polyolefin resin and a nitrogen-containing polymer in water or an organic solvent on the surface portions of the main body of insulator such as an arc-extinguishing nozzle, said surface portions being exposed to arcs, followed by heat treatment thereof.

(2) A method of preparing a mixed solution by dispersing or dissolving in water or an organic solvent a polyolefin resin and a conventional maleimide series resin composition (containing one or more diamines or polymerizable vinyl monomers, etc.) or a poly(amic acid) capable of forming imide rings as the nitrogen-containing polymer in the same manner as mentioned in above (1), coating the mixed solution on the surface portions to be exposed to arcs of the main body of insulator, and curing the resin by heat treatment.

When an inorganic filler powder is used together, the following methods can be employed:

(3) A method wherein the inorganic filler powder is added to the mixed solution obtained in either method (1) or (2) mentioned above.

(4) A method of coating the surfaces of the inorganic filler powder particles with the nitrogen-containing polymer shown in the method (2), if necessary heating the resulting powder particles, coating a mixed solution obtained by dispersing or dissolving the resulting powder particles and an polyolefin resin in water or an organic solvent on the surface portions of the insulator main body to be exposed to arcs, followed by heat treatment.

(5) A method of coating the polyolefin resin powder with a solution (varnish) of nitrogen-containing polymer obtained according to the method (2), if necessary heating the resulting coated powder, preparing a mixed solution by dispersing or dissolving the resulting resin powder and an inorganic filler powder in water or an organic solvent, and conducting coating and heat treatment in the same manner as described in the method (2).

In addition, in the case of coating a resin mixture, there can be employed a known fluidization dip coating method or the like.

The molding of a mixture of a polyolefin resin and a nitrogen-containing polymer, and if necessary an inorganic filler powder, can be carried out by a conventional method. For example, when a fluorocarbon resin is used as polyolefin resin, it is general that a powdery resin mixture is preformed, followed by a heat treatment at a temperature of softening point under pressure or without pressure. Needless to say, it is also possible to employ an extrusion molding method, and the like.

This invention is illustrated by way of the following Examples, in which all parts and percents are by weight unless otherwise specified.

EXAMPLES 1 TO 23

To 10 parts of boron nitride powder having an average particle size of 5 μm, a varnish of precursor of polyimide resin (concentration, about 10%) or a polyamide resin, the kind and amount of which are shown in Table 1, was added and mixed. After treating the mixture with heating at 200° C. for 2 hours, 100 parts of polytetrafluoroethylene (PTFE) was added thereto and mixed. After preforming the resulting resin mixture under an ordinary pressure molding method, the preformed resin was baked at about 370° C. to give an arc-extinguishing nozzle for a gas insulating breaker as shown in FIG. 2. The resulting nozzle was installed in a circuit breaker as shown in FIG. 1.

Properties of the resulting breaker are shown in Table 2. In Table 2, the inner arc resistance is evaluated by whether free carbon is generated or not (o no free carbon; x free carbon) after 10 breaking tests at 300 kV and 50 kA. The insulating performance is evaluated by a percent obtained by dividing a value of dielectric strength along the surface at the portion deteriorated by the arc after the breaking tests by that before the breaking tests. The mechanical strenght is shown by a percent based on the strength of pure PTFE. The nozzle wastage amount is evaluated by a percent obtained by dividing a bore diameter of the nozzle after the breaking tests by that before the breaking tests.

TABLE 1

| Example No. | Nitrogen-containing polymer or inorganic filler | Amount (parts) |
|---|---|---|
| Example 1 | Polyimide (A) 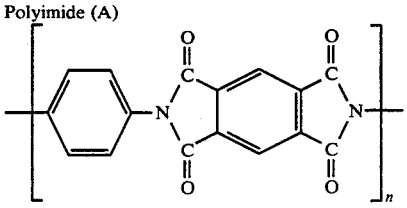 | 0.01 |
| Example 2 | | 0.1 |
| Example 3 | | 1.0 |
| Example 4 | | 10 |
| Example 5 | | 20 |
| Example 6 | Polyimide (B) 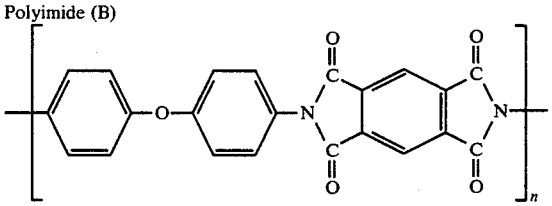 | 0.1 |
| Example 7 | | 1.0 |
| Example 8 | | 5.0 |
| Example 9 | Polyimide (C) 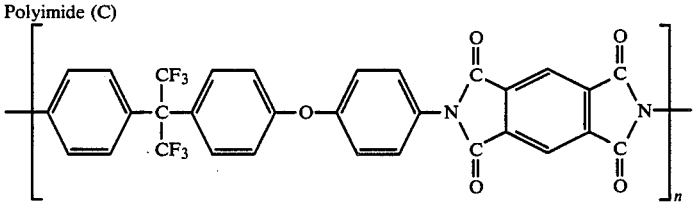 | 0.1 |
| Example 10 | | 1.0 |
| Example 11 | | 5.0 |
| Example 12 | Polyimide-isoindroquinazolinedione (PIQ) (manufactured by Hitachi Chemical Co., Ltd.) | 0.1 |
| Example 13 | | 1.0 |
| Example 14 | | 5.0 |
| Example 15 | Polyamideether 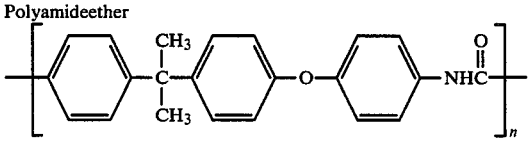 | 0.1 |
| Example 16 | | 1.0 |
| Example 17 | | 5.0 |
| Example 18 | Polybenzimidazole 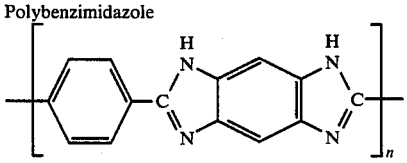 | 0.1 |
| Example 19 | | 1.0 |
| Example 20 | | 5.0 |

TABLE 1-continued

| Example No. | Nitrogen-containing polymer or inorganic filler | Amount (parts) |
|---|---|---|
| Example 21 | Polybenzoxazole | 0.1 |
| Example 22 | | 1.0 |
| Example 23 | | 5.0 |
| Comparative Example 1 | Boron nitride | 10* |
| Comparative Example 2 | Alumina | 10* |
| Prior art | Bronze | 10* |

Note to Table 1:
*Each inorganic filler powder was added to 100 parts of PTFE to mold an arc-extinguishing nozzle.

TABLE 2

| Example No. | Inner arc resistance | Insulating performance (%) | Mechanical strength (%) | Nozzle wastage amount (%) |
|---|---|---|---|---|
| Example 1 | o | 100 | — | 104 |
| Example 2 | o | 100 | — | 103 |
| Example 3 | o | 100 | — | 102 |
| Example 4 | o | 100 | — | 102 |
| Example 5 | o | 95 | — | 102 |
| Example 6 | o | 100 | — | 103 |
| Example 7 | o | 100 | — | 102 |
| Example 8 | o | 100 | — | 102 |
| Example 9 | o | 100 | — | 103 |
| Example 10 | o | 100 | — | 102 |
| Example 11 | o | 100 | — | 102 |
| Example 12 | o | 100 | 100 | 103 |
| Example 13 | o | 100 | 150 | 102 |
| Example 14 | o | 100 | 170 | 102 |
| Example 15 | o | 97 | — | 104 |
| Example 16 | o | 99 | — | 103 |
| Example 17 | o | 100 | — | 104 |
| Example 18 | o | 98 | — | 103 |
| Example 19 | o | 100 | — | 102 |
| Example 20 | o | 100 | — | 102 |
| Example 21 | o | 98 | — | 103 |
| Example 22 | o | 100 | — | 102 |
| Example 23 | o | 100 | — | 102 |
| Comparative Example 1 | o | 80 | 50 | 121 |
| Comparative Example 2 | x | 50 | 50 | 121 |
| Prior art | x | 50 | 50 | 121 |

EXAMPLE 24

After mixing 100 parts of PTFE and 10 parts of varnish of precursor of polyimideisoindroquinazolinedione (concentration 10%, a PIQ varnish manufactured by Hitachi Chemical Co., Ltd., Japan), the mixture was kneaded at 200° C. for 2 hours to give a poly(amic acid)treated PTFE powder. Then, 10 parts of boron nitride powder was added thereto and mixed. An arc-extinguishing nozzle was produced from the resulting mixture and installed in a circuit breaker in the same manner as described in Example 1.

Properties of the breaker were the same as those of Example 10.

EXAMPLE 25

Using a mixture of 100 parts of PTFE, 10 parts of boron nitride powder having an average particle size of 5 μm and 1 part of PIQ powder having an average particle size of 0.01 μm, an arc-extinguishing nozzle was produced and installed in the same manner as described in Example 1.

Properties of the breaker were the same as those of Example 13.

The resin insulator made from a nitrogen containing polymer and a polyolefin resin, and if necessary together with an inorganic filler can be used not only in the portions exposed to arcs but also in the portions indirectly exposed to arc by reflection.

The $SF_6$ gas arc extinguishing electric apparatus of this invention can effectively be used as circuit breakers, particularly as breakers for higher breaking voltages. Particularly effective high voltage is 150 kV or higher. The $SF_6$ gas insulating electric apparatus of this invention can be used as a $SF_6$ gas arc extinguishing insulating transformer or a spacer in gas insulated equipments. Further, when the apparatus of this invention is used as circuit breakers, concrete apparatus are explained in detail in, for example, U.S. Pat. Nos. 3,621,171 and 3,839,613.

What is claimed is:

1. In a $SF_6$ gas arc extinguishing electric apparatus containing an $SF_6$ arc extinguishing gas and a resin insulator, both of which are present in an atmosphere to be exposed to arcs, the improvement wherein at least the surface portion to be exposed to arcs of said resin insulator is made from a mixture of a polymer containing nitrogen atoms and a polyolefin resin, whereby said polymer containing nitrogen atoms improves the surface arc resistance and inner arc resistance of said polyolefin resin.

2. A $SF_6$ gas arc extinguishing electric apparatus according to claim 1, wherein the polyolefin resin is a fluorocarbon resin and the polymer containing nitrogen atoms is one having the same or higher heat resistance compared with the fluorocarbon resin.

3. A $SF_6$ gas arc extinguishing electric apparatus according to claim 1 or 2, wherein the polymer containing nitrogen atoms is a polyimide resin.

4. In an $SF_6$ gas arc extinguishing electric apparatus containing an $SF_6$ arc extinguishing gas and a resin insulator, both of which are present in an atmosphere to be exposed to arcs, the improvement wherein at least the surface portion to be exposed to arcs of said resin insulator is made from a mixture of a polymer containing nitrogen atoms, a polyolefin resin, and at least one of an inorganic filler powder and an organic pigment, whereby said polymer containing nitrogen atoms improves the surface arc resistance and inner arc resistance of said polyolefin resin.

5. A $SF_6$ gas arc extinguishing electric apparatus according to claim 4, wherein the resin insulator is made from a mixture of a polyolefin resin and an inorganic filler powder coated with a polymer containing nitrogen atoms.

6. A $SF_6$ gas arc extinguishing electric apparatus according to claim 4 or 5, wherein the polyolefin resin is a fluorocarbon resin and the polymer containing nitrogen atoms is one having the same or higher heat resistance compared with the fluorocarbon resin.

7. A $SF_6$ gas arc extinguishing electric apparatus according to claim 4, wherein the resin insulator further contains an organic pigment.

8. In an $SF_6$ arc extinguishing breaker having a metallic case filled with an $SF_6$ arc extinguishing gas and having installed therein:

(a) a pair of fixed contact and moving contact, which contacts can be opened or closed along the axis direction, (b) an apparatus for compressing the $SF_6$ gas and operating in relation to opening and closing of said two contacts, and (c) an arc-extinguishing nozzle made from a resin and separating an orifice portion from the fixed arcing contact at the time of opening so as to lead the $SF_6$ gas from said compressing apparatus mentioned above through the orifice portion to the fixed contact side, the improvement wherein at least the surface portion of the arc-extinguishing nozzle to be exposed to arcs is made from a resin insulator obtained from a mixture of a polymer containing nitrogen atoms and a polyolefin resin, whereby said polymer containing nitrogen atoms improves the surface arc resistance and inner arc resistance of said polyolefin resin.

9. A $SF_6$ gas arc extinguishing breaker according to claim 8, wherein all of the arc extinguishing nozzle is made from a resin insulator obtained from a mixture of a polymer containing nitrogen atoms and a polyolefin resin.

10. A $SF_6$ gas arc extinguishing breaker according to claim 8 or 9, wherein the arc-extinguishing nozzle is made from a resin insulator obtained from a mixture of a polyimide as polymer containing nitrogen atoms and a polyolefin resin.

11. A $SF_6$ gas arc extinguishing breaker according to claim 8 or 9, wherein the arc-extinguishing nozzle is made from a resin insulator obtained from a mixture of a polyimide as polymer containing nitrogen atoms, a polyolefin resin and an inorganic filler powder, whereby said polymer containing nitrogen atoms also improves adhesiveness between the polyolefin resin and the inorganic filler powder.

12. A $SF_6$ gas arc extinguishing breaker according to claim 8 or 9, wherein the arc-extinguishing nozzle is made from a resin insulator obtained from a mixture of a polyimide as polymer containing nitrogen atoms, a polyolefin resin, and at least one of an inorganic filler powder and an organic pigment.

13. In a process for producing an $SF_6$ gas arc extinguishing electric apparatus containing an $SF_6$ arc extinguishing gas and a resin insulator, both of which are present in an atmosphere to be exposed to arcs, the improvement comprising making at least the surface portion to be exposed to arcs of said resin insulator by using a resin mixture comprising a poly(amic acid) capable of forming imide rings and a polyolefin resin, and heat treating the resin mixture to form imide rings, whereby the resin containing the imide rings improves the surface arc resistance and inner arc resistance of said polyolefin resin.

14. In a process for producing an $SF_6$ gas arc extinguishing electric apparatus containing an $SF_6$ arc extinguishing gas and a resin insulator, both of which are present in an atmosphere to be exposed to arcs, the improvement comprising making at least the surface portion to be exposed to arcs of said resin insulator by using a resin mixture comprising a poly(amic acid) capable of forming imide rings, a polyolefin resin, and at least one of an inorganic filler powder and an organic pigment, and heat treating the resin mixture to form imide rings, whereby the resin containing the imide rings improves the surface arc resistance and inner arc resistance of said polyolefin resin.

15. An $SF_6$ arc extinguishing electric apparatus according to claim 1, 2, 4 or 7, wherein said polymer containing nitrogen atoms is an aromatic polyamide.

16. An $SF_6$ arc extinguishing electric apparatus according to claim 1, 4 or 7, wherein said polyolefin resin is polyethylene, polypropylene, an ethylene-propylene copolymer or a halogenated polyolefin.

17. An $SF_6$ arc extinguishing electric apparatus according to claim 1, or 2, wherein the nitrogen-containing polymer is used in an amount of 0.01–10 parts by weight and the polyolefin resin is used in an amount of 0.1–10 parts by weight.

18. An $SF_6$ arc extinguishing electric apparatus according to claim 4, wherein the resin insulator further includes an organic filler powder, wherein the polymer containing nitrogen atoms also improves adhesiveness between the polyolefin resin and the inorganic filler powder.

19. An $SF_6$ arc extinguishing electric apparatus according to claim 18, wherein the resin insulator further includes a coupling agent to further enhance adhesive strength between the inorganic filler powder and the polyolefin resin or the polymer containing nitrogen atoms.

* * * * *